United States Patent [19]

Meyer

[11] 4,321,571

[45] Mar. 23, 1982

[54] ROTARY ACTUATOR WITH SELECTABLE RESPONSE CHARACTERISTICS

[75] Inventor: Hal G. Meyer, Rockford, Ill.

[73] Assignee: Precision Governors, Inc., Rockford, Ill.

[21] Appl. No.: 91,251

[22] Filed: Nov. 5, 1979

[51] Int. Cl.[3] ..... H01F 7/14

[52] U.S. Cl. ..... 335/272; 335/181

[58] Field of Search ..... 335/128, 177, 181, 183, 335/272

[56] References Cited

U.S. PATENT DOCUMENTS

| | | | |
|---|---|---|---|
| 3,201,661 | 8/1965 | Koutnik | 335/272 X |
| 3,221,191 | 11/1965 | Cuches et al. | 335/272 X |
| 3,278,875 | 10/1966 | McDonough | 335/272 |
| 3,435,394 | 3/1969 | Egger | 335/272 |
| 3,694,782 | 9/1972 | Ray | 335/272 X |

FOREIGN PATENT DOCUMENTS

| | | | |
|---|---|---|---|
| 1052197 | 12/1966 | United Kingdom | 335/272 |

*Primary Examiner*—George Harris

*Attorney, Agent, or Firm*—McDougall, Hersh & Scott

[57] ABSTRACT

A rotary actuator is disclosed useful in controlling throttle settings on internal combustion engines. The angular displacement of the actuator shaft is a function of the current applied to the actuator. In the disclosed embodiment the relationship between current and angular displacement has three distinct regions: increasing displacement, linear displacement and decreasing displacement with respect to applied current. These regions are matched to the engine characteristics to produce a desired response from the engine. The actuator consists of a rotor biased by a coil spring to a first position and displaceable to a plurality of intermediate positions by magnetic actuation from pole pieces associated with current carrying coils. The arrangement and configuration of the rotor and pole pieces produce the desired three region response characteristic.

10 Claims, 11 Drawing Figures

ROTARY ACTUATOR WITH SELECTABLE RESPONSE CHARACTERISTICS

BACKGROUND OF THE INVENTION

This invention relates to the field of governor technology. More specifically, it relates to the field of electromechanical actuators which produce a mechanical response to an electrical input. In general, actuators can be classed as either linear or rotary. In a linear actuator an output shaft is extended or retracted as a function of current applied to a set of coils. By well known mechanical means this linear movement may be converted to rotary movement to control, for example, the angular position of a butterfly valve on an engine carburetor.

The second class of actuators produce rotary motion directly and generally involve toroidal pole pieces which produce angular displacement of a rotor as a function of applied current. Exemplary of this class of actuators is U.S. Pat. No. 3,435,394 to Egger disclosed more fully in the prior art statement.

The present invention relates to rotary actuators and discloses a construction which improves upon the prior art in several important respects. Because engines or similar devices which are controlled by actuators vary in response over their operating range, it is often necessary to provide nonlinear controls for the devices if satisfactory operation is to be obtained. Thus, for example, in the case of an internal combustion engine where the fuel system is controlled by an actuator connected to a carburetor butterfly valve, it will be recognized by those skilled in the art that the initial movement of the butterfly valve has a much more significant effect on engine RPM than would the same amount of angular displacement of the valve near full throttle. The actuator device or its associated electronic control circuit must be able to compensate for the nonlinearities of the engine response if accurate control is to be obtained. This can be accomplished according to the present invention by matching portions of the response characteristics of the actuator to the response characteristics of the engine to be controlled.

It is accordingly an object of the present invention to provide an improved rotary actuator which has a current versus displacement response characteristic with three distinct regions whereby the appropriate region or regions can be matched to the response characteristics of the controlled device.

It is a further object of the present invention to provide a rotary actuator having improved geometry whereby high torque can be produced with relatively low amperage.

It is another object of the present invention to provide a rotary actuator in which the rotor is provided with end surfaces formed by off center radii and the corresponding pole pieces are reciprocally formed to produce a three region displacement versus current response characteristic.

A further object of the invention is to provide a rotary actuator in which the dimensional relationship between the rotor and the pole piece is selected to further shape the response characteristics of the actuator.

Other objects and advantages of the invention will be apparent from the remaining portion of the specification.

DETAILED DESCRIPTION

Figure 1:
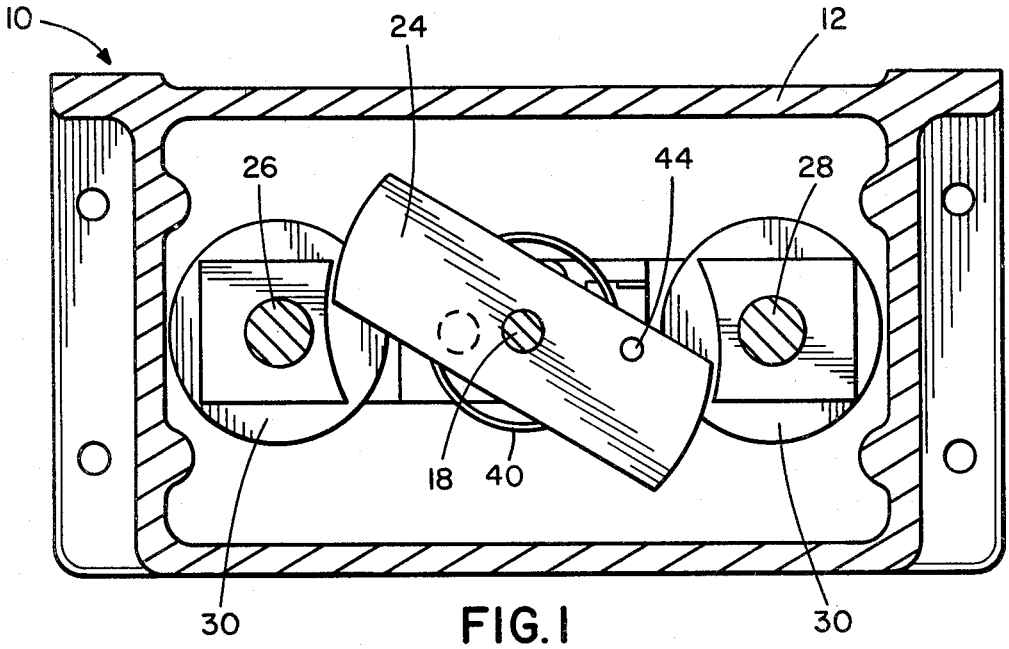
FIG. 1 is a top plan view of the rotary actuator according to the invention.
Figure 2:
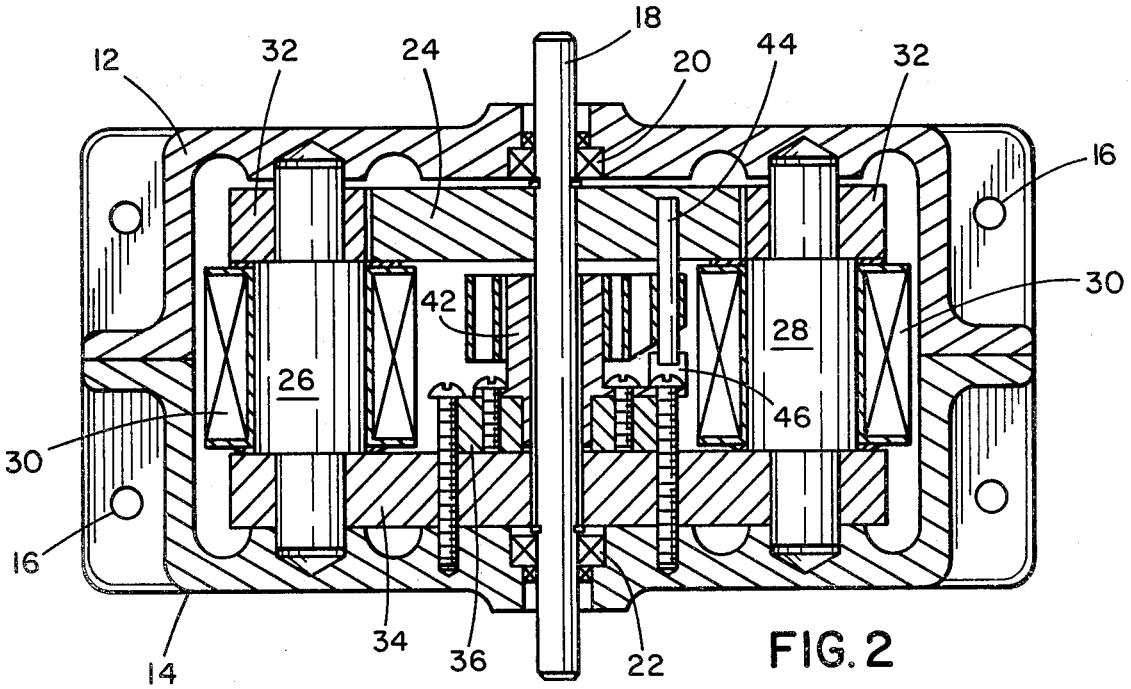
FIG. 2 is a side elevation in cross section through the actuator according to the invention.
Figure 3:
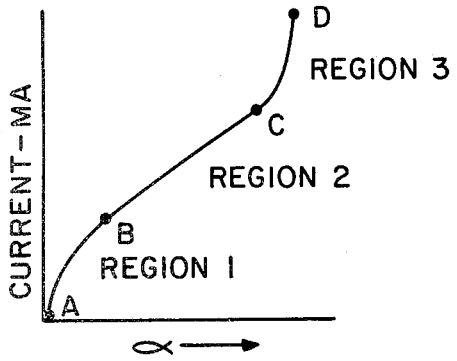
FIG. 3 is a graph of angular displacement versus current illustrating the characteristic obtained according to the present invention.

Referring to FIGS. 1, 2 and 3, a preferred embodiment of the invention is illustrated. The rotary actuator is enclosed in a case 10 which may be formed of suitable nonmagnetic material, such as aluminum. The case consists of halves 12 and 14 which can be secured together by bolting or other conventional means. The case is provided with apertures 16 for securing the unit to a device to be controlled thereby.

The actuator includes an output shaft 18 rotatably mounted in bearings 20 and 22. In the usual arrangement the output shaft 18 is coupled to the control element of an engine or other device whereby rotation of the shaft is effective for controlling a desired variable such as fuel flow. In the case of carburetted internal combustion engines the output shaft 18 would be coupled to the butterfly valve of the carburetor. The output shaft passes through the outer enclosure 10 and secured near one end of the shaft is a rotor 24 formed of ferromagnetic material.

The housing is provided with a pair of support elements 26 and 28 which are generally cylindrical in shape. Concentrically mounted over a central portion of the support elements are coils 30. The coils are formed by a plurality of windings of conductive wire and, in a manner well known by those skilled in the art, the coils are connected to an electrical circuit whereby current is applied to the coils. Secured to the supports 26 and 28 adjacent the coils 30 and directly thereabove are magnetic pole pieces 32. A base 34 is positioned beneath the coils 30 and secured to the support elements 26 and 28. The base is formed of ferromagnetic material as are the pole pieces and the rotor. As indicated in FIG. 2, the output shaft 18 passes through an aperture in the base 34.

As will be recognized by those skilled in the art, the base 34, pole pieces 32 and rotor 24 form a magnetic circuit when current is applied to the coils 30. The magnetic circuit produces torque tending to align the rotor with the pole pieces. To compensate for the aperture provided in the base 34 and maintain proper flux density, a block element 36 of ferromagnetic material is mounted on the base 34 in contact therewith. The block 36 has an aperture therethrough for accommodating the output shaft 18.

The rotor, in the absence of current being applied to the coils 30 is biased to a first position substantially as indicated in FIG. 1 by a coil spring 40. The inner end of the coil spring is secured to a grounding spool 42 concentrically disposed over the output shaft and secured to the block 36. The out end of the spring is secured to the rotor in any conventional manner. For the purpose of restricting movement of the rotor between certain limits a pin 44 is secured thereto and extends downwardly to a point near the top of the block 36. Mounted at a selectable location on the block is a stop element 46 having two upwardly extending flange members. The pin 44 engages the flange members at either extreme of the rotor's movement.

Summarizing the structure thus far described and with reference to FIGS. 1 and 2, it will be readily apparent that electrical current is applied to the coils 30 for the purpose of creating a magnetic circuit, the force therefrom counteracting the bias of spring 40. This causes the rotor 24 to move from its initial position indicated in FIG. 1 to some intermediate position more nearly in alignment with the pole pieces 32. The amount of movement of the rotor and subsequent rotation of the output shaft is a function of the amount of current applied to the coils 30 and the geometry of the rotor and pole pieces. The present invention results in a response characteristic which is particularly useful in interfacing the actuator with devices to be controlled, such as gasoline and diesel engines.

In the usual case the response characteristic (angular displacement of the output shaft versus applied current) will vary from device to device and has no particular characteristic which permits ready adaptation of the actuator to the controlled device. As the actuator output shaft is displaced, the response of the engine or other device is monitored by a feedback circuit to see what further adjustment or correction is required until a desired set point is reached. By providing a rotary actuator with a desired response characteristic, it is possible to produce a highly accurate control device for engines. Set points can be much more rapidly obtained with less hunting and the requirement for sophisticated control circuits is reduced.

Referring now to FIG. 3, there is disclosed a graph of the response characteristic obtained according to the present invention. The horizontal axis represents angular displacement of the output shaft from an initial position determined by the spring 40 while the vertical axis indicates the amount of current required to produce the displacement. The waveform illustrated on the graph may be seen to possess three distinct regions. Region 1 is the portion between points A and B; region 2 the portion between points B and C; while region 3 is the portion between points C and D. It will be observed that region 1 provides increasing angular displacement with respect to the amount of applied current. That is, each succeeding unit of current applied in region 1 produces more angular displacement than the previous unit of current. Region 2 is a linear region in which each applied unit of current produces approximately the same amount of angular displacement as the previous unit. Region 3 has a decreasing response characteristic in which each succeeding unit of current produces less angular displacement then the preceding unit.

A response characteristic of the type illustrated in FIG. 3 can be beneficially utilized in virtually all applications where actuators are employed to control machinery whether they be internal combustion engines, generators, electric motors or other types of devices. The advantage of a response characteristic of the type illustrated in FIG. 3 is that selected regions of the actuator characteristic can be matched to the response characteristic of the device to be controlled whereby a substantially linear relationship between the actuator and the control device can be established. Thus, if the device to be controlled has a decreasing response characteristic initially, the region 1 curve of the present actuatlor is appropriate when making set point changes. Where the device to be controlled operates essentially linearly the region 2 portion of the response characteristic can be matched to the device. A similar statement is true with respect to region 3.

To provide a specific example, an internal combustion engine RPM may be controlled by coupling the actuator to the carburetor butterfly valve. It is well known that small angular displacement of the butterfly valve produces a large change in the amount of fuel supplied when the engine is idling. Conversely, when the engine is running at high power, similar position changes of the butterfly valve produce very small changes in the engine speed, while intermediate butterfly valve positions produce nearly linear changes in engine speed. This characteristic of carburetted engines can be matched to the response characteristic of actuators produced according to the present invention to, in effect, linearize the engine's response characteristic permitting relatively easy and highly accurate control. Thus, region 1 of the actuator would be matched to the idling region of the butterfly valve providing greater sensitivity in controlling low speed operation of the engine. Region 2 of FIG. 3 would be matched to the intermediate positions of the butterfly valve while region 3 would be matched to the high power positions whereby more accurate control of that area can be obtained.

By way of further example, in the case if diesel engines the response characteristic is essentially linear. Accordingly, only region 2 of the actuator would be utilized. The stops 46 are set accordingly to restrict actuator movement to the linear region.

Figure 4:
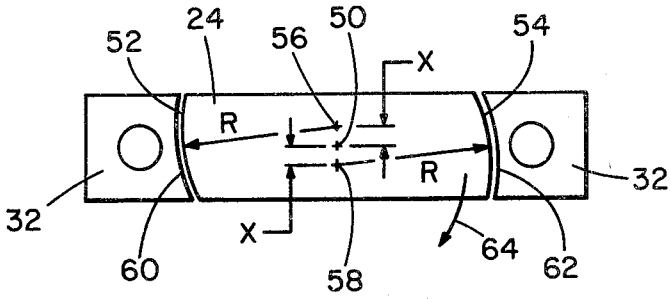
FIG. 4 is a schematic drawing of the rotor and pole pieces of the present invention indicating the geometric design features thereof.

Referring now to FIGS. 4 through 7, structural details of the rotor and pole pieces which produce the FIG. 3 characteristic are illustrated and will be described. As seen in FIG. 4, the rotor 24 has a central point or centroid 50 and rotates about this point on the output shaft 18. The ends of the rotor designated 52 and 54 are curved in the manner illustrated. The radii of curvature for surfaces 50 and 52 are offset from the centroid 50. Thus, end 52 is formed by machining the surface with a constant radius using a point 56 offset from the centroid 50 by a distance X. Similarly, surface 54 is formed in a similar manner using a point 58 and the same radius R, point 58 being offset from the centroid by the same distance X but on the side opposite point 56.

The pole pieces 32 are similarly formed so that they have surfaces 60 and 62 which complement the surfaces 52 and 54. As can be appreciated from FIG. 4, when the rotor moves in the direction of the arrow 64, the gap between the pole pieces 32 and the rotor 24 changes varying the magnetic flux which passes through the circuit. The specific contours herein disclosed produce the highly useful response characteristic illustrated in FIG. 3.

Figure 5A:
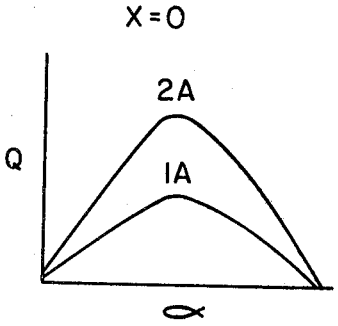
FIG. 5A, B and C are graphs of angular displacement versus torque illustrating the effect of the geometry described in connection with FIG. 4.
Figure 5B:
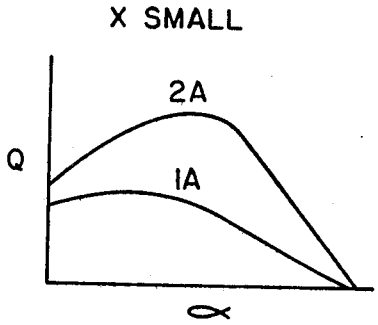
Figure 5C:
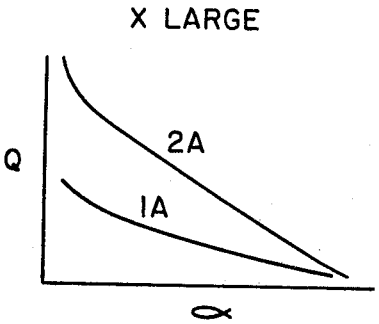

With respect to FIG. 5, the effect of the parameter X upon the response characteristic is illustrated. FIG. 5A illustrates the case where $X=0$, that is, the surface 52 and 54 are formed by using a radius of curvature located at the centroid 50. In that case torque (Q) varies symmetrically with angular displacement (α). Each curve illustrated is for a different value of current (A). FIG. 5B illustrates the torque versus angular displacement where X is "small", on the order of 0.045 inches, while FIG. 5C illustrates torque versus angular displacement for "large"values of X, on the order of 0.070 inches. As will be apparent in comparing FIGS. 5A, B and C, as the value X increases from 0, the symmetry of the curves disappears. The slope of the left side of the curves changes from positive to negative. This geometry alteration produces the response characteristic of the form shown in FIGS. 3.

The graphs of FIGS. 5 and 7 may be correlated with the response characteristics of FIG. 3 by merely plotting a spring force line on the FIG. 5 and 7 graphs. This will permit computation of the FIG. 3 response characteristic for a given torque-angular displacement curve. It will be noted that the right portions of the curves of FIG. 5 remain approximately the same. Thus, the inversion of the left portions of the curves produces the three region curve illustrated in FIG. 3.

Figure 6A:
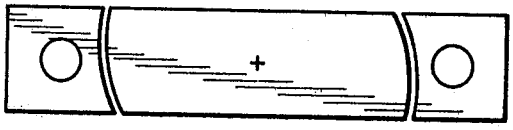
FIGS. 6A and B are schematic diagrams similar to FIG. 4.
Figure 6B:
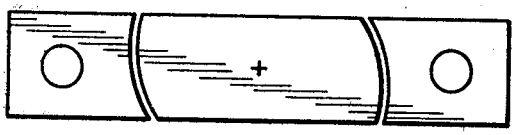
Figure 7A:
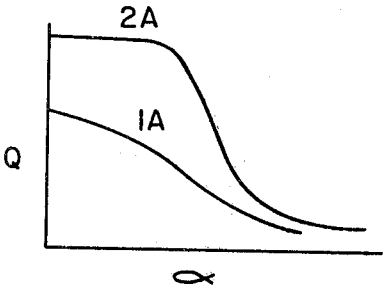
FIGS. 7A and B are graphs similar to FIG. 5 illustrating the effect of the geometry of the FIG. 6 constructions.
Figure 7B:
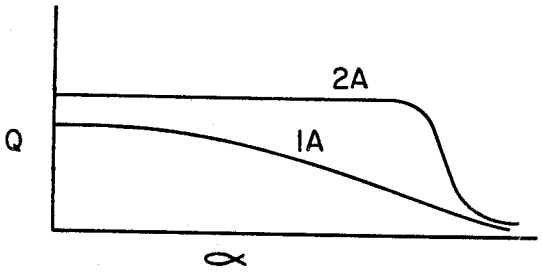

The final shaping of the response characteristic illustrated in FIG. 3 can be controlled by other variations in the geometry of the rotor and pole pieces. Thus, as indicated in FIGS. 6 and 7, the relative lengths of the rotor and pole pieces have a material affect upon the response characteristic. The rotor of FIG. 6A has the characteristic indicated at FIG. 7A. Shortening the rotor and lengthening the pole pieces, as illustrated in FIG. 6B, causes an elongation of the characteristics as shown in FIG. 7B. Thus, the size and relationship or regions 1, 2 and 3 can be varied as desired. Thus, a large linear region can be produced, if desired, or alternatively, a large region 1 or 3 can be produced.

While I have shown and described embodiments of this invention in some detail, it will be understood that this description and illustrations are offered merely by way of example, and that the invention is to be limited in scope only by the appended claims.

I claim:

1. A variable position rotary actuator having a selectable response characteristic comprising:

(a) a housing formed of nonmagnetic material, (b) an output shaft mounted for rotation between first and second positions in said housing and extending therefrom for connection to a device to be controlled by said actuator.

(c) means for biasing said rotor to said first position, out of alignment with said pole pieces, (d) magnetic circuit means in said housing including: electrical coils, pole pieces associated with said coils, a rotor secured to said shaft for movement therewith, said rotor and shaft being angularly displaceable to a selectable position intermediate said first and second positions by magnetic force when electric current is passed through said coils, said intermediate position being a function of the magnitude of the current passing through said coils, (e) said rotor and pole pieces having a geometric configuration producing a current versus angular displacement characteristic having three distinct regions including a linear region and regions of increasing and decreasing angular displacement.

2. A variable position rotary actuator having a selectable response characteristic comprising:

(a) a housing, (b) an output shaft mounted for rotation between first and second positions in said housing and extending therefrom for connection to a device to be controlled by said actuator, (c) means for biasing said shaft to said first position, (d) electrically energized magnetic circuit means for angularly displacing said shaft from said first position to any of a number of positions intermediate said first and second positions as a function of the magnitude of the electric current applied to said magnetic current means, (e) said magnetic circuit means including a rotor attached to said shaft for movement therewith and pole pieces to which the rotor is magnetically attracted, the geometric configuration of said rotor and pole pieces producing a current versus angular displacement of the shaft characteristic having three distinct regions including a linear region and regions of increasing and decreasing angular displacement.

3. A rotary actuator according to claim 1 or claim 2 further including means for limiting the movement of said shaft to select said first position and the maximum angular displacement therefrom.

4. A rotary actuator according to claim 3 wherein said limiting means is a stationary stop member and a pin secured to said rotor for movement therewith, said pin engaging said stop member to restrict movement of said shaft.

5. A rotary actuator according to claim 1 wherein said magnetic circuit has two electrical coils and two pole pieces, said pole pieces being disposed on opposite sides of said output shaft.

6. A rotary actuator according to claim 1 or claim 2 wherein said biasing means is a coil spring.

7. A rotary actuator according to claim 1 claim 2 wherein said rotor is an elongated member, the ends of which are magnetically attracted to said pole pieces to produce angular displacement of said shaft, each of said rotor ends being curved in a convex manner, the radius of the curvature of each end being taken from a point spaced from the center of said rotor, each of said points being equidistant from the rotor center and on opposite sides thereof.

8. A rotary actuator according to claim 7 wherein the surface of each pole piece to which an end of said rotor is magnetically attracted is curved in a concave manner, complimentary to the curvature of the rotor end, whereby a variable gap or spacing between the rotor ends and each pole piece is defined, the variable gap producing the desired three region current versus angular displacement response characteristic.

9. A rotary actuator according to claim 7 wherein the distance of each point from said center is greater than 0.04 inches.

10. A rotary actuator according to claim 7 wherein said points define a line perpendicular to the longitudinal direction of said rotor.

* * * * *